US009523961B2

(12) United States Patent
Kobayashi et al.

(10) Patent No.: US 9,523,961 B2
(45) Date of Patent: Dec. 20, 2016

(54) SWITCH DEVICE AND TIMEPIECE

(71) Applicant: CASIO COMPUTER CO., LTD., Tokyo (JP)

(72) Inventors: Kazuma Kobayashi, Fuchu Tokyo (JP); Junichi Sato, Hino Tokyo (JP); Yoshihiro Maruyama, Hamura Tokyo (JP); Masao Amano, Uenohara Yamanashi (JP)

(73) Assignee: CASIO COMPUTER CO., LTD. (JP)

( * ) Notice: Subject to any disclaimer, the term of this patent is extended or adjusted under 35 U.S.C. 154(b) by 0 days.

(21) Appl. No.: 14/624,979

(22) Filed: Feb. 18, 2015

(65) Prior Publication Data

US 2015/0234358 A1 Aug. 20, 2015

(30) Foreign Application Priority Data

Feb. 19, 2014 (JP) ..... 2014-029391

(51) Int. Cl.
*G04B 27/02* (2006.01)
*G04B 3/04* (2006.01)
(Continued)

(52) U.S. Cl.
CPC ..... *G04B 43/002* (2013.01); *G04B 3/043* (2013.01); *G04B 3/046* (2013.01); *G04B 27/02* (2013.01); *G04B 37/055* (2013.01)

(58) Field of Classification Search
CPC ..... G04B 3/041; G04B 37/02; G04B 37/04; G04B 37/055; G04B 37/10; G04B 43/002; G04B 3/046; G04B 3/043; G04B 27/02
See application file for complete search history.

(56) References Cited

U.S. PATENT DOCUMENTS 2,465,571 A * 3/1949 Boninchi ..... G04B 37/10 277/553
3,699,767 A 10/1972 Piquerez et al.
(Continued)

FOREIGN PATENT DOCUMENTS

JP 2001-166066 A 6/2001
JP 2006-194834 7/2006
JP 2009-008522 A 1/2009

OTHER PUBLICATIONS

English Translation of Japanese Office Action dated Dec. 8, 2015 for the Japanese Patent Application No. 2014-029391. (4 pages).
(Continued)

*Primary Examiner* — Vit W Miska
(74) *Attorney, Agent, or Firm* — Fitch Even Tabin & Flannery LLP

(57) ABSTRACT

A watch case having a through-hole, an operating member including an operating shaft to be inserted to the through-hole of the watch case, an exterior member mounted on the operating member and configured to be displaced in a shaft direction of the operating shaft and be rotated together with the operating member, and a buffer member located between the operating member and the exterior member are provided. Therefore, when the exterior member receives impact from outside, the impact can be buffered by the buffer member. As a result, the operating member can be prevented from being damaged because the impact from the outside is not directly transmitted to the operating member, thereby improving impact resistance.

7 Claims, 6 Drawing Sheets

(51) Int. Cl.
*G04B 37/05* (2006.01)
*G04B 43/00* (2006.01)

(56) References Cited

U.S. PATENT DOCUMENTS

| | | | | |
|---|---|---|---|---|
| 6,453,512 | B1 * | 9/2002 | Kaelin | G04B 3/041 16/441 |
| 6,762,976 | B1 * | 7/2004 | Tamaru | G04B 37/005 368/281 |
| 7,255,473 | B2 | 8/2007 | Hiranuma et al. | |
| 2004/0257917 | A1 * | 12/2004 | Yoshikawa | G04B 37/055 368/318 |
| 2005/0007891 | A1 * | 1/2005 | Hiranuma | G04B 37/103 368/318 |
| 2005/0207285 | A1 * | 9/2005 | Omori | G04B 37/10 368/319 |
| 2006/0158964 | A1 | 7/2006 | Hiranuma et al. | |
| 2008/0068934 | A1 * | 3/2008 | Hiranuma | G04B 3/043 368/288 |
| 2010/0220562 | A1 * | 9/2010 | Hozumi | G04B 3/043 368/308 |
| 2013/0155821 | A1 * | 6/2013 | Tsuji | G04B 37/0008 368/281 |
| 2013/0205939 | A1 * | 8/2013 | Meerovitsch | G05G 1/02 74/553 |
| 2014/0078872 | A1 * | 3/2014 | Kitahara | G04B 3/04 368/320 |
| 2014/0286146 | A1 * | 9/2014 | Sakurazawa | G04B 3/043 368/308 |

OTHER PUBLICATIONS

Japanese Office Action dated Jun. 30, 2016 for JP2014-029391 and English translation of the same. (12 pages).

* cited by examiner

SWITCH DEVICE AND TIMEPIECE

CROSS-REFERENCE TO RELATED APPLICATION

This application claims priority under the Paris Convention to Japanese Application No. 2014-029391, filed Feb. 19, 2014, the contents of which are incorporated herein by reference in its entirety.

BACKGROUND OF THE INVENTION

1. Technical Field

The present invention relates to a switch device used in a timepiece, such as a watch, and a timepiece provided therewith.

2. Related Art

For example, there is a known technology disclosed in JP 2006-194834 A, which includes a switch device provided with an operating member such as a crown mounted on a watch case in a manner possible to be pulled out. This type of switch device has a configuration in which the operating member projected outside from the watch case is moved in a pullout direction, and time is corrected by rotating the operating member in the pullout state.

Such a switch device has a configuration in which a winding stem pipe is set in a through-hole of a watch case, a shaft of an operating member is inserted into the winding stem pipe, an outer end portion of the winding stem is set at the shaft of the operating member, and the outer end portion of the shaft is provided with an operating head portion projected to the outside of the watch case.

Further, the switch device includes a locking unit configured to lock the operating member in a state that the operating member is pushed inside at the time when the time is not corrected. The locking unit includes a ring member attached to an operating head portion and having a plurality of engagement projections, and a plurality of locking groove portions provided at an outer peripheral portion of the winding stem pipe projected to the outside of the watch case and configured to lock the engagement projections of the ring member in a disengageable manner.

In the switch device thus configured, when the operating member is rotated, the engagement projections of the ring member are rotated, the locked state of the engagement projections with respect to the plurality of locking groove portions is released, and the time can be corrected by moving the operating member in the pullout direction and rotating the same in this state. Further, in the event of rotating the operating member while being pushed inside, the operating member is locked in the state being pushed inside by the engagement projections of the ring member being rotated and locked by the plurality of locking groove portions.

However, in the switch device thus configured, in the case where the operating head portion of the operating member receives impact from the outside while the operating member is pushed inside and locked, there is a problem in which the shaft and the locking unit of the operating member may be damaged because the impact is directly applied to the operating member.

An object of the present invention is to provide a switch device capable of buffering the impact from the outside and improving impact resistance, and a timepiece provided with such a switch device.

SUMMARY OF THE INVENTION

The switch device includes: a case having a through-hole; an operating member having a shaft to be inserted into the through-hole of the case; an exterior member mounted on the operating member and configured to be displaced in a shaft direction of the shaft and rotated together with the operating member; and a buffer member located between the operating member and the exterior member.

BRIEF DESCRIPTION OF THE DRAWINGS

FIG. 2A is an enlarged external view thereof, and FIG. 2B is an enlarged cross-sectional view thereof taken along a line A-A indicated by arrows;

FIG. 6A is the enlarged front view of the engaging flange portion of the operating member, and FIG. 6B is the enlarged front view of the fitting portion of the exterior member.

DETAILED DESCRIPTION

In the following, an embodiment in which the present invention is applied to a watch will be described with reference to FIGS. 1 to 6B.

Figure 1:
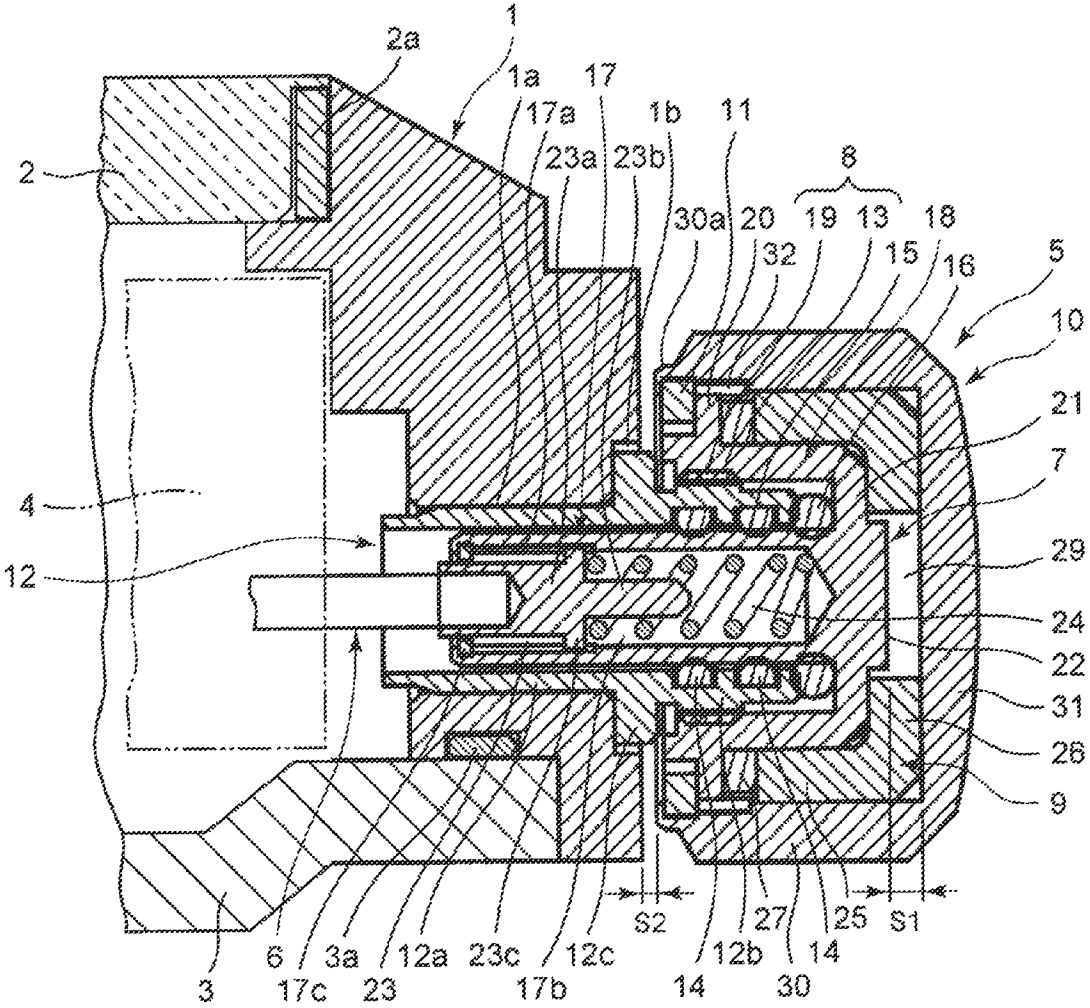
FIG. 1 is an enlarged cross-sectional view illustrating a main portion of a watch according to an embodiment in which the present invention is applied to the watch.

The watch includes a watch case 1 as illustrated in FIG. 1. A watch glass 2 is mounted on an upper opening portion of the watch case 1 via a packing 2*a*, and a back cover 3 is mounted at a lower portion of the watch case 1 via a waterproof packing 3*a*.

Additionally, a timepiece module 4 is provided inside the watch case 1 as illustrated in FIG. 1. Further, a switch device 5 is provided at a side portion of the watch case 1 as illustrated in FIG. 1. The switch device 5 is provided to switch a mode of the timepiece module 4 and correct time, and includes a winding stem 6, an operating member 7, a locking unit 8, a buffer member 9, an exterior member 10, and a mounting member 11.

In this case, as illustrated in FIG. 1, a through-hole 1*a* penetrating from the inside to the outside of the watch case 1 is provided at the side portion of the watch case 1. A counterbore portion 1*b* having a diameter larger than an inner diameter of the through-hole 1*a* is provided at an outer end portion of the through-hole 1*a*. A metal-made cylindrical member 12 is fitted inside the through-hole 1*a*.

The cylindrical member 12 includes, as illustrated in FIG. 1, a small-diameter cylindrical portion 12*a* fitted inside the through-hole 1*a* and projected to the inside of the watch case 1, and a large-diameter cylindrical portion 12*b* projected to the outside of the watch case 1 from the counterbore portion 1*b* of the through-hole 1*a*. A flange portion 12*c* to be fitted to the counterbore portion 1*b* of the through-hole 1*a* is provided in a boundary portion between the small-diameter cylindrical portion 12*a* and the large-diameter cylindrical portion 12*b* of the cylindrical member 12.

Further, as illustrated in FIG. 1, a male screw 13 of the locking unit 8 is provided on an outer peripheral surface of the large-diameter cylindrical portion 12*b* of the cylindrical member 12, more specifically, at a portion projected to the outside from the through-hole 1*a* of the watch case 1 on the outer peripheral surface of the large-diameter cylindrical portion 12*b*. Furthermore, as illustrated in FIG. 1, a plurality of packing grooves 15 is provided on an inner peripheral surface of the cylindrical member 12, and a waterproof packing 14 is mounted on each of the plurality of the packing grooves 15.

The operating member 7 of the switch device 5 includes, as illustrated in FIGS. 1 to 5, an operating shaft 17 formed in a cylindrical shape having a small diameter slightly smaller than the inner diameter of the cylindrical member 12, and an operating head portion 18 formed in a cylindrical shape at an outer end portion of the operating shaft 17, and these components are integrally formed of metal. The operating head portion 18 includes, as illustrated in FIG. 1, an inner portion formed in a hollow shape having a size to be inserted with the large-diameter cylindrical portion 12*b* of the cylindrical member 12.

More specifically, as illustrated in FIG. 1, the operating head portion 18 includes the inner portion formed to have a shaft-direction length (depth) slightly longer than the length of the large-diameter cylindrical portion 12*b* of the cylindrical member 12 projected to the outside from the watch case 1. Further, a female screw 19 to be screw-engaged with the male screw 13 of the locking unit 8 provided at the cylindrical member 12 is disposed at an inner periphery located on the watch case 1 side in the operating head portion 18. The female screw 19 is configured to be screw-engaged with the male screw 13 in a state that the operating member 7 is pushed into the watch case 1.

Due to this, the locking unit 8 includes, as illustrated in FIG. 1, the male screw 13 provided at the outer periphery of the cylindrical member 12 and the female screw 19 provided at the inner periphery of the operating head portion 18, and when the operating member 7 is pushed toward the inside of the watch case 1 and the female screw 19 comes close to the male screw 13, the female screw 19 is configured to be screw-engaged with the male screw 13 by rotation of the operating head portion 18, and then locked in a state that the operating member 7 is pushed inside.

Figure 2A:
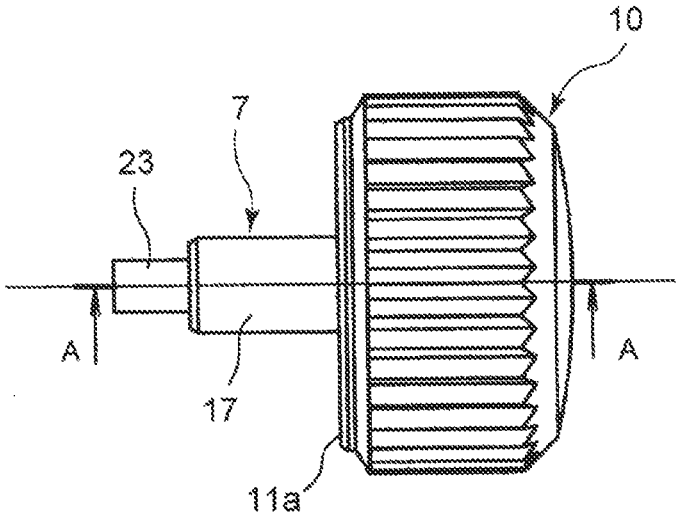
FIGS. 2A and 2B are diagrams illustrating the main portion of a switch device of the watch illustrated in FIG. 1 in a state that an operating member and an exterior member are removed from a watch case.
Figure 2B:
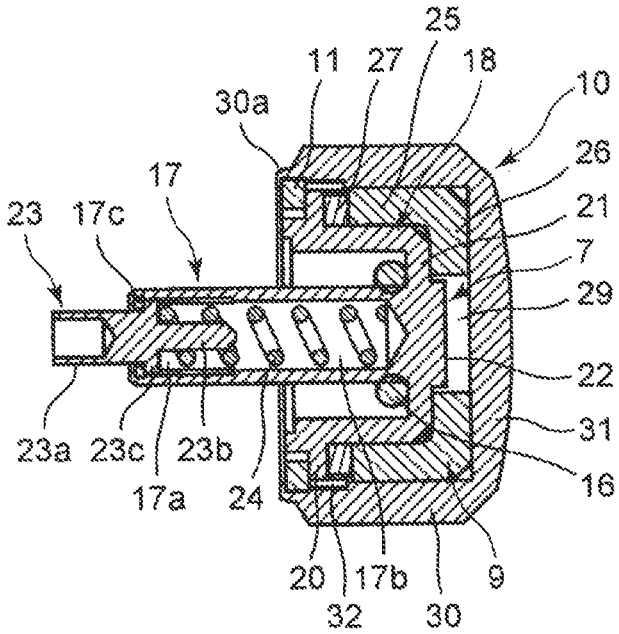
Figure 3:
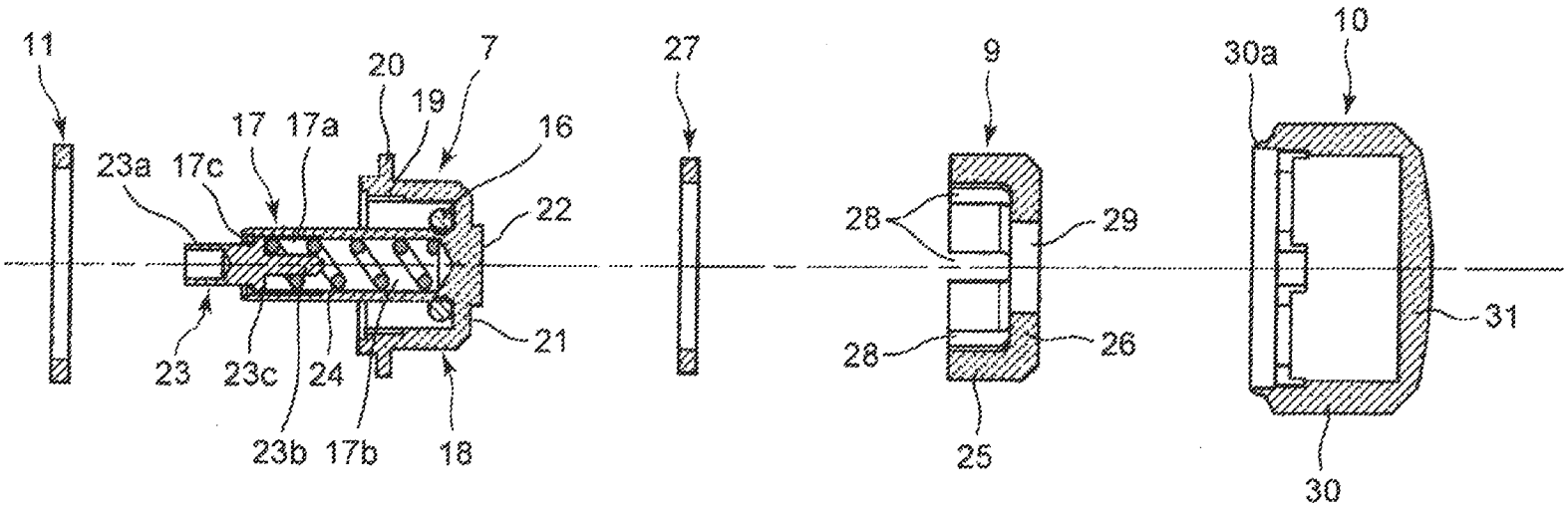
FIG. 3 is an enlarged cross-sectional view illustrating an exploded main portion of the switch device illustrated in FIG. 2B.

In this case, a rubber ring 16 is disposed at a deep portion between the operating head portion 18 and the operating shaft 17 as illustrated in FIGS. 1 to 3. The rubber ring 16 is configured to be pushed into the deep portion between the operating head portion 18 and the operating shaft 17 by an outer end portion of the large-diameter cylindrical portion 12*b* of the cylindrical member 12, and further elastically pushed against the operating head portion 18 and the operating shaft 17 by the end portion of the large-diameter cylindrical portion 12*b* of the cylindrical member 12.

Further, a square-shaped engaging flange portion 20 is provided in a projecting manner at the outer peripheral portion located on the watch case 1 side in the operating head portion 18 as illustrated in FIGS. 1 to 5. The engaging flange portion 20 is, as illustrated in FIG. 6A, formed in a shape in which tips of respective corner portions 20*a* of the square are cut along an arc shape centering a center shaft of the operating head portion 18. Also, in the operating head portion 18, a head wall portion 21 is provided at an outer end portion located on the outer side of the watch case 1. On the outer surface of the head wall portion 21, a disk-shaped projected portion 22 having a size substantial same as the outer diameter of the operating shaft 17 is formed corresponding to the operating shaft 17.

On the other hand, the operating shaft 17 of the operating member 7 is formed in a cylindrical shape to be inserted into the inside of the cylindrical member 12 as illustrated in FIGS. 1 to 5. The operating shaft 17 is disposed at a center portion on an inner surface of the head wall portion 21 of the operating head portion 18, in a manner projecting toward the watch case 1 side. The operating shaft 17 is formed shorter than the cylindrical member 12. With this configuration, the operating shaft 17 is configured so as not to be projected from the inside of the cylindrical member 12 to the inside of the watch case 1 while the operating member 7 is being pushed inside and locked by the locking unit 8.

Inside the operating shaft 17, a square hole 17*a* having a square cross-section located on the watch case 1 side and a circular hole portion 17*b* having a circular cross-section located on the operating head portion 18 side of the square hole 17*a* are provided along the shaft direction as illustrated in FIGS. 1 to 3. In this case, the circular hole portion 17*b* is formed in a circular shape inscribed in an inner surface of the square hole 17*a*.

Further, as illustrated in FIGS. 1 to 3, a winding stem mounting portion 23 where an outer end portion of the winding stem 6 is mounted in a manner movable in the shaft direction is provided inside the operating shaft 17. The winding stem mounting portion 23 includes an interlocking shaft 23*a* to be inserted inside the square hole 17*a* of the operating shaft 17 in a movable manner and a guide shaft 23*b* to be inserted inside the circular hole portion 17*b* of the operating shaft 17 in movable manner and disposed on the outer end portion of the interlocking shaft 23*a*.

In this case, a rotary flange portion 23*c* is provided in a projecting manner in a radial direction at a boundary portion between the interlocking shaft 23*a* and the guide shaft 23*b* of the winding stem mounting portion 23 as illustrated in FIGS. 1 to 3. The rotary flange portion 23*c* is formed in a square plate shape, and movably inserted into the square hole 17*a* of the operating shaft 17. In this state, the rotary flange portion 23*c* is rotated together with rotation of the operating shaft 17, and the rotation is transmitted to the winding stem mounting portion 23 so as to rotate the winding stem 6.

In this case, as illustrated in FIGS. 1 to 3, the rotary flange portion 23*c* is configured to contact, in a separable manner, a stopper portion 17*c* disposed at the square hole 17*a* of the operating shaft 17 located on the inner side of the watch case 1, thereby preventing the rotary flange portion 23*c* from being slipped out from the operating shaft 17 to the inner side of the watch case 1.

Further, the guide shaft 23*b* of the winding stem mounting portion 23 is formed sufficiently thinner than the inner diameter of the circular hole portion 17*b* as illustrated in FIGS. 1 to 3. A coiled spring 24 is disposed between an outer peripheral surface of the guide shaft 23*b* and an inner peripheral surface of the circular hole portion 17*b*. The coiled spring 24 has one end portion elastically contacting the rotary flange portion 23*c* of the winding stem mounting portion 23 and the other end portion elastically contacting the deep portion (on the right end portion in FIG. 2B) of the circular hole portion 17*b* of the operating shaft 17, and configured to bias the operating shaft 17 in a push-out direction from the inside of the cylindrical member 12 in this state.

In this manner, the operating member 7 is configured such that the coiled spring 24 is compressed between the operating head portion 18 and the rotary flange portion 23*c* of the winding stem mounting portion 23 and the operating shaft 17 is moved toward the inside of the watch case 1 inside the cylindrical member 12 and the operating head portion 18 comes close to the watch case 1 when the operating head portion 18 is pushed inside against spring force of the coiled spring 24 in a state that the winding stem mounting portion 23 is fixed by the winding stem 6 as illustrated in FIG. 1.

Further, in the operating member 7, the winding stem mounting portion 23 is fixed by the winding stem 6 and also the operating shaft 17 is pushed into the cylindrical member 12 as illustrated in FIG. 1. Further, in the case where the locked state of the locking unit 8 with respect to the operating shaft 17 is released in the state that the operating head portion 18 is positioned close to the watch case 1 and locked by the locking unit 8, the winding stem mounting portion 23 is configured to push out the operating shaft 17 by the spring force of the coiled spring 24 and the operating head portion 18 is pushed outside from the watch case 1 as illustrated in FIGS. 2B and 3.

Furthermore, as illustrated in FIGS. 1 to 3, the operating member 7 is configured such that the operating shaft 17 is rotated together with the operating head portion 18 by rotating the operating head portion 18 in both states that the operating head portion 18 is pushed in and the operating head portion 18 is pushed out, and the rotation is transmitted to the winding stem mounting portion 23 by the rotary flange portion 23*c* of the winding stem mounting portion 23 inserted into the square hole 17*a* of the operating shaft 17 so as to rotate the winding stem 6 by the rotation of the interlocking shaft 23*a* of the winding stem mounting portion 23.

On the other hand, the buffer member 9 is located between the operating head portion 18 and the exterior member 10 at the operating head portion 18 of the operating member 7 as illustrated in FIGS. 1 to 5. The buffer member 9 is formed of synthetic resin having elasticity, such as an urethane rubber, a silicone rubber, or elastomer, and includes: a buffer cylinder portion 25 closely contacting an outer peripheral surface of the operating head portion 18; and a buffer plate portion 26 closely contacting the head wall portion 21, namely, an outer end portion of the operating head portion 18.

The buffer cylinder portion 25 of the buffer member 9 is, as illustrated in FIGS. 1 to 5, located at the outer periphery of the operating head portion 18 and formed in a cylindrical shape. More specifically, the buffer cylinder portion 25 has an inner diameter substantially same as the outer diameter of the operating head portion 18, and has a shaft-direction length shorter than a length from the engaging flange portion 20 of the operating head portion 18 to the head wall portion 21.

Figure 4:
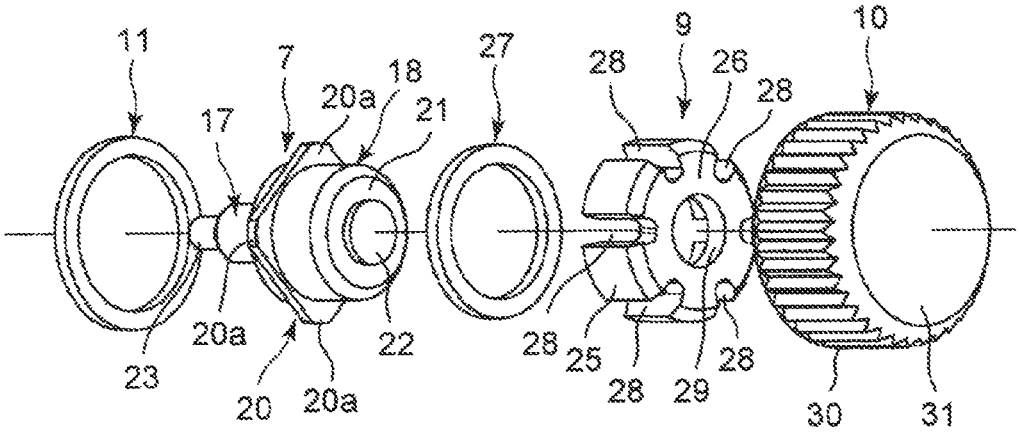
FIG. 4 is an enlarged perspective view illustrating the exploded main portion of the switch device illustrated in FIG. 2A, viewed from the outside of the watch case.
Figure 5:
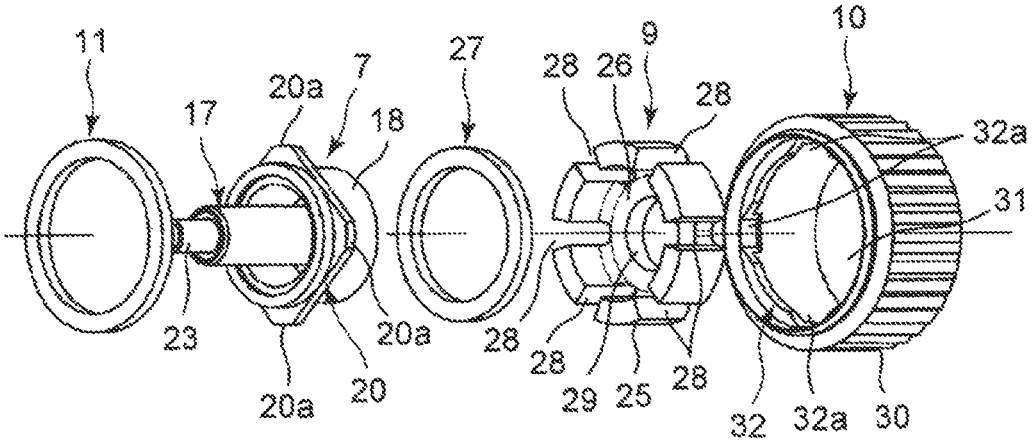
FIG. 5 is an enlarged perspective view illustrating the exploded main portion of the switch device illustrated in FIG. 2A, viewed from the watch case side.
Figure 6A:
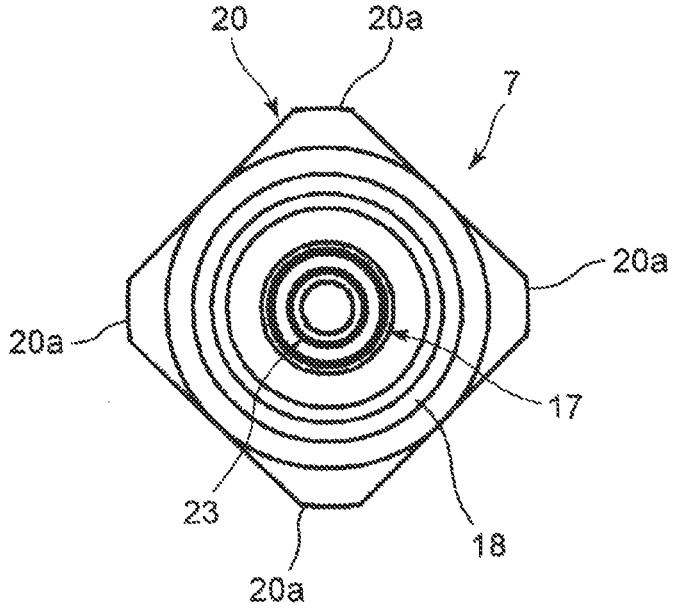
FIGS. 6A and 6B are diagrams illustrating an engaging flange portion of an operating member and a fitting portion of an exterior member illustrated in FIG. 5.

The buffer cylinder portion 25 is, as illustrated in FIGS. 3 to 5, provided with a plurality of slit grooves 28 formed along the shaft direction thereof at predetermined intervals in a circumferential direction. The slit groove 28 is an escape space when the buffer member 9 is elastically deformed. With this configuration, the buffer cylinder portion 25 is formed so as to be elastically deformed in the shaft direction and further elastically deformed in the circumferential direction by the plurality of slit grooves 28 in the state of being mounted on the operating head portion 18.

In this case, as illustrated in Figs. Ito 3, an internal rubber ring 27 for dust-proof is provided between an end portion of the buffer cylinder portion 25 located on the watch case 1 side and the engaging flange portion 20 of the operating head portion 18. The rubber ring 27 is formed to have an inner diameter substantially same as the outer diameter of the operating head portion 18 and an outer diameter substantially same as an outer diameter of the buffer cylinder portion 25.

Further, as illustrated in FIGS. 1 to 5, the buffer plate portion 26 of the buffer member 9 includes an insertion hole 29 penetrating in the shaft direction thereof, corresponding to the operating shaft 17 of the operating member 7. The insertion hole 29 is an escape space when the buffer member 9 is elastically deformed. With this configuration, the buffer plate portion 26 is formed so as to be elastically deformed in the shaft direction and further elastically deformed in the radial direction, namely, a surface direction while being attached to the operating head portion 18.

In this case, as illustrated in FIGS. 1 and 2B, the disk-shaped projected portion 22 provided at the operating head portion 18 is inserted into the insertion hole 29 of the buffer plate portion 26. The projected portion 22 is formed to have an outer diameter smaller than an inner diameter of the insertion hole 29 of the buffer plate portion 26. Further, the projected portion 22 is formed to have a projected length in the shaft direction smaller than a depth of the insertion hole 29, namely, thickness of the buffer plate portion 26.

The exterior member 10 is, as illustrated in FIGS. 1 to 5, formed of metal and configured to be mounted on an outer periphery of the buffer member 9. More specifically, the exterior member 10 includes: a cylindrical portion 30 to be mounted on the outer periphery of the buffer cylinder portion 25 of the buffer member 9; and a head wall portion 31 to be mounted on an outer surface of the buffer plate portion 26 of the buffer member 9, and these components are integrally formed of metal.

As illustrated in FIGS. 1 and 2B, the cylindrical portion 30 is formed to have an inner diameter same as the outer diameter of the buffer cylinder portion 25 and a shaft-direction length longer than the shaft-direction length of the buffer cylinder portion 25. More specifically, the cylindrical portion 30 is formed to have the shaft-direction length same as the length from the buffer plate portion 26 of the buffer member 9 to the end portion of the operating head portion 18 of the operating member 7 located on the watch case 1 side, thereby achieving to cover the buffer member 9 and the operating head portion 18 of the operating member 7.

Figure 6B:
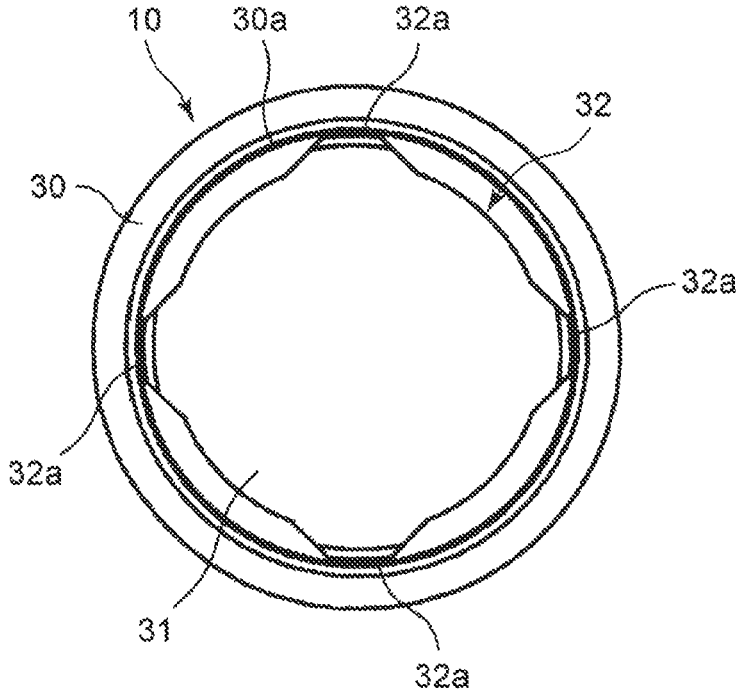

Further, as illustrated in FIG. 6B, a fitting portion 32 to which the engaging flange portion 20 of the operating head portion 18 is fitted movable in the shaft direction is formed on an inner peripheral surface of the cylindrical portion 30. The fitting portion 32 is formed in a circular hole slightly larger than the outer diameter of the operating head portion 18, and includes a configuration in which an engagement recess 32*a* to be individually engaged with each of corner portions 20*a* of the square-shaped engaging flange portion 20 is formed at an edge portion of the circular hole.

Therefore, the operating member 7 and the exterior member 10 are configured such that rotation of the exterior member 10 is transmitted to the operating head portion 18 of the operating member 7 by the engaging flange portion 20 of the operating head portion 18 being fitted to the fitting portion 32 of the cylindrical portion 30 in the state that each of the corner portions 20*a* of the engaging flange portion 20 of the operating head portion 18 is engaged with each of the engagement recesses 32*a* of the fitting portion 32 at the cylindrical portion 30, thereby rotating the operating member 7 together with the exterior member 10.

The mounting member 11 is formed in a metal-made ring shape as illustrated in FIGS. 1 to 5. The mounting member 11 is fixed inside the cylindrical portion 30 of the exterior member 10, and contacted with the engaging flange portion 20 of the operating head portion 18 in a direction of the watch case 1 side. In this state, the exterior member 10 is configured to be displaced with respect to the operating head portion 18 in the shaft direction. In this case, a caulking portion 30*a* configured to fix the mounting member 11 through caulking processing is provided at an end portion of the cylindrical portion 30 located on the watch case 1 side of the exterior member 10.

By this, as illustrated in FIGS. 1 to 3, the mounting member 11 is disposed at the end portion inside the cylindrical portion 30 of the exterior member 10 and configured to be fixed inside the cylindrical portion 30 by applying the caulking processing to the caulking portion 30*a* of the cylindrical portion 30 in this state. Further, the mounting member 11 is pushed by the engaging flange portion 20 of the operating head portion 18 with elastic force of the buffer member 9, and the exterior member 10 is configured to be displaced toward the watch case 1 side in this state.

In this case, a first space S1 is provided between the projected portion 22 disposed at the head wall portion 21 of the operating head portion 18 of the operating member 7 and the head wall portion 31 of the exterior member 10 as illustrated in FIG. 1. Further, a second space S2 is provided between the end portion of the cylindrical portion 30 of the exterior member 10 and an outer surface of the watch case 1.

As illustrated in FIG. 1, the first space Si is set wider than the second space S2. With this configuration, the exterior member 10 is configured such that the head wall portion 31 of the exterior member 10 does not contact the projected portion 22 of the operating head portion 18 of the operating member 7 when the buffer member 9 is elastically deformed by receiving impact from the outside although the end portion of the cylindrical portion 30 of the exterior member 10 contacts the outer surface of the watch case 1.

By the way, the winding stem 6 is, as illustrated in FIG. 1, mounted on the interlocking shaft 23*a* of the winding stem mounting portion 23 disposed slidably inside the operating shaft 17 of the operating member 7, and in this state, the winding stem 6 is disposed extending inside the timepiece module 4 provided inside the watch case 1. The winding stem 6 is configured to keep a state in which a switch of the timepiece module 4 is not actuated while the coiled spring 24 is compressed by the operating head portion 18 of the operating member 7 being pushed inside and the operating member 7 is locked by the female screw 19 of the operating member 7 being screw-engaged with the male screw 13 of the cylindrical member 12.

Further, as illustrated in FIG. 1, the winding stem 6 is configured to keep the state the switch of the timepiece module 4 is not actuated while screw-engagement between the female screw 19 of the operating member 7 and the male screw 13 of the cylindrical member 12 is released by rotating the operating head portion 18 of the operating member 7 and the operating head portion 18 of the operating member 7 is pushed out by the spring force of the coiled spring 24.

Furthermore, the winding stem 6 is moved in the pullout direction along with the pullout operation of the operating head portion 18 when the operating member 7 is pushed out by releasing the locked state of the locking unit 8 with respect to the operating member 7 in the state illustrated in FIG. 1 and the operating head portion 18 of the operating member 7 is further pulled out in this state. As a result, a normal timepiece mode is switched to a time correction mode. When the operating head portion 18 is rotated in this state, the winding stem 6 is configured to be rotated along with this rotation so as to correct the time in accordance with rotation of the winding stem 6.

Next, operation of the switch device 5 of the thus configured watch will be described.

In the case of using the switch device 5, the exterior member 10 provided at the operating head portion 18 of the operating member 7 is pinched and rotated in the state illustrated in FIG. 1. Then, the operating head portion 18 is rotated, and the female screw 19 of the operating member 7 is rotated along with the rotation, and the locked state of the locking unit 8 with respect to the operating member 7 is released.

More specifically, the engaging flange portion 20 provided at the operating head portion 18 of the operating member 7 is fitted to the fitting portion 32 provided inside the cylindrical portion 30 of the exterior member 10, and also each of the corner portions 20*a* of the engaging flange portion 20 is engaged with the engagement recess 32*a* of the fitting portion 32, thereby transmitting rotation of the exterior member 10 to the operating head portion 18 when the exterior member 10 is pinched and rotated. As a result, the operating head portion 18 is rotated and also the operating shaft 17 of the operating member 7 is rotated.

Thus, when the operating head portion 18 is rotated, the female screw 19 of the operating head portion 18 is rotated. Therefore, screw-engagement of the male screw 13 of the cylindrical member 12 with the female screw 19 is released and the female screw 19 is separated from the male screw 13. The locked state of the locking unit 8 with respect to the operating member 7 is released by this.

When the locked state of the locking unit 8 with respect to the operating member 7 is thus released, the operating shaft 17 of the operating member 7 is pushed out to the outside of the watch case 1 by the spring force of the coiled spring 24 provided inside the operating shaft 17 of the operating member 7. At this point, the winding stem 6 is not moved in the shaft direction, and therefore, the winding stem mounting portion 23 of the winding stem 6 is not also moved along with the movement of the operating shaft 17 and kept stopped.

Due to this, the rotary flange portion 23*c* of the winding stem mounting portion 23 is relatively moved toward the watch case 1 side inside the square hole 17*a* of the operating shaft 17 along with movement of the operating shaft 17, and contacts a stopper portion 17*c* of the operating shaft 17. Further, the guide shaft 23*b* of the winding stem mounting portion 23 is relatively moved toward the inside of the square hole 17*a* of the operating shaft 17 along with movement of the operating shaft 17.

When the operating shaft 17 is thus moved toward the outside of the watch case 1 inside the cylindrical member 12, the operating head portion 18 is separated from the watch case 1 and projected to the outside. Even though the winding stem 6 is rotated via the operating head portion 18 by rotating the exterior member 10 in this state, the switch of the timepiece module 4 is not actuated. Further, when the operating head portion 18 is further pulled out, the winding stem 6 is pulled out because the operating shaft 17 is moved along with this pullout movement of the operating head portion 18 and the winding stem mounting portion 23 is moved to the outside of the watch case 1.

At this point, the switch of the timepiece module 4 is actuated by the pullout movement of the winding stem 6, and the timepiece mode is switched from the normal timepiece mode to the time correction mode. When the operating head portion 18 is rotated by rotating the exterior member 10 in this state, the winding stem mounting portion 23 is rotated along with the rotation, and the winding stem 6 is rotated by rotation of the winding stem mounting portion 23, thereby correcting the time in accordance with rotation of the winding stem 6.

On the other hand, in the case of not using the switch device 5, the operating head portion 18 of the operating member 7 is first pushed inside against the spring force of the coiled spring 24, and the timepiece mode is switched to the normal timepiece mode. In this state, the operating head portion 18 is further pushed inside against the spring force of the coiled spring 24 and made to contact the outer surface of the watch case 1.

Then, the female screw 19 of the operating head portion 18 comes close to the male screw 13 and can be screw-engaged with the male screw 13 of the cylindrical member 12. In this state, the exterior member 10 is rotated to rotate the operating head portion 18, the female screw 19 of the operating head portion 18 is screw-engaged with the male screw 13 of the cylindrical member 12 as illustrated in FIG. 1. Thus, the operating member 7 is locked by the locking unit 8 while being pushed inside.

At this point, the first space S1 is provided between the projected portion 22 disposed at the head wall portion 21 of the operating head portion 18 of the operating member 7 and the head wall portion 31 of the exterior member 10, and also the second space S2 is provided between the end portion of the cylindrical portion 30 of the exterior member 10 and the outer surface of the watch case 1. In this case, the first space S1 is set wider than the second space S2 as illustrated in FIG. 1.

When the exterior member 10 receives impact from the outside in this state, the operating member 7 is locked to the cylindrical member 12 of the watch case 1 by the locking unit 8, and therefore, the buffer member 9 is compressed and elastically deformed by the exterior member 10. More specifically, when the exterior member 10 receives the impact in the shaft direction, the buffer plate portion 26 of the buffer member 9 is compressed in the shaft direction and also the buffer cylinder portion 25 of the buffer member 9 is compressed in the shaft direction together with the rubber ring 27. By this, the impact from the outside is not directly transmitted to the operating member 7 and buffered by the buffer member 9. As a result, the operating member 7 and the locking unit 8 are prevented from being damaged.

In this case, when strong impact is applied to the exterior member 10, there may be a case in which the impact cannot be sufficiently absorbed by the buffer member 9 although the buffer member 9 is compressed and elastically deformed. In such a case, the exterior member 10 is displaced in the shaft direction along with compression and deformation of the buffer member 9, and the end portion of the cylindrical portion 30 of the exterior member 10 contacts the outer surface of the watch case 1. However, at this point, the head wall portion 31 of the exterior member 10 does not contact the projected portion 22 of the operating head portion 18 of the operating member 7. Therefore, the strong impact is not directly transmitted to the operating member 7 although the exterior member 10 receives the strong impact.

More specifically, the first space S1 provided between the projected portion 22 disposed at the head wall portion 21 of the operating head portion 18 of the operating member 7 and the head wall portion 31 of the exterior member 10 is set wider than the second space S2 provided between the end portion of the cylindrical portion 30 of the exterior member 10 and the outer surface of the watch case 1. Therefore, even when the exterior member 10 receives the strong impact and the buffer member 9 cannot sufficiently absorb the impact, the end portion of the cylindrical portion 30 of the exterior member 10 contacts the outer surface of the watch case 1. As a result, the impact is not directly transmitted to the operating member 7. In this manner, the operating member 7 and locking unit 8 are prevented from being damaged.

Further, when the exterior member 10 receives impact from an oblique direction crossing with the shaft direction, the buffer member 9 is compressed in the shaft direction and further elastically deformed in the circumferential direction, thereby buffering the impact from the oblique direction by the buffer member 9. As a result, the impact from the oblique direction is not directly transmitted to the operating member 7.

More specifically, the buffer cylinder portion 25 of the buffer member 9 is provided with the plurality of slit grooves 28 formed along the shaft direction thereof at the predetermined intervals in the circumferential direction. Therefore, the buffer cylinder portion 25 is elastically deformed in the shaft direction and further elastically deformed in the circumferential direction by the plurality of the slit grooves 28. With this configuration, even when the exterior member 10 receives the impact from the oblique direction crossing with the shaft direction, the impact is buffered by the buffer member 9 and not directly transferred to the operating member 7. As a result, the operating member 7 and the locking unit 8 are prevented from being damaged.

Thus, according to the switch device 5 of the watch, the impact from the outside can be buffered by the buffer member 9 by including: the watch case 1 having the through-hole 1*a*; the operating member 7 having the operating shaft 17 to be inserted into the through-hole 1*a* of the watch case 1, and the operating head portion 18 disposed at the outer end portion; the exterior member 10 mounted on the operating member 7 and configured to be displaced in the shaft direction of the operating shaft 17 and rotated together with the operating member 7; and the buffer member 9 located between the exterior member 10 and the operating member 7. As a result, impact resistance can be improved.

In other words, according to the switch device 5 of the watch, when the exterior member 10 receives the impact from the outside, the impact can be buffered by the buffer member 9. Therefore, since the impact from the outside can be prevented from being directly transmitted to the operating member 7, the operating member 7 can be prevented from being damaged by the impact from the outside, thereby achieving to improve impact resistance. Due to this, there is no need to provide any guard portion on the outer surface of the watch case 1 to enclose the periphery of the exterior member 10, and the watch case 1 is unconstrained by appearance and design, and therefore, design flexibility is increased.

In this case, the outer peripheral portion of the buffer member 9, namely, the buffer cylinder portion 25 of the buffer member 9 is provided with the plurality of the slit grooves 28 formed along the shaft direction thereof at the predetermined intervals in the circumferential direction. Therefore, the buffer member 9 can be elastically deformed in the shaft direction of the operating member 7 and also the buffer cylinder portion 25 of the buffer member 9 can be elastically deformed in the circumferential direction successfully by the plurality of slit grooves 28. Therefore, even when the impact from the outside is applied to the exterior member 10 from the oblique direction crossing with the shaft direction, the impact can be surely and successfully buffered by the buffer member 9.

Further, the end portion of the buffer member 9 located in the shaft direction, namely, the buffer plate portion 26 of the buffer member 9 is provided with the insertion hole 29 penetrating in the shaft direction thereof, corresponding to the operating shaft 17 of the operating member 7. Therefore, the buffer plate portion 26 of the buffer member 9 is elastically deformed in the shaft direction of the operating member 7 and further the buffer plate portion 26 can be deformed in the radial direction, namely, the surface direction thereof by the insertion hole 29. As a result, impact from the outside can be surely and successfully buffered by the buffer plate portion 26 of the buffer member 9.

Thus, the buffer cylinder portion 25 of buffer member 9 is provided with the plurality of slit grooves 28 at the predetermined intervals in the circumferential direction, and further the buffer plate portion 26 is provided with the insertion hole 29. Therefore, even when the impact from the outside is applied to the exterior member 10 from the oblique direction crossing with the shaft direction, or even when the impact from the outside is applied to the exterior member 10 in the shaft direction, the impact can be surely and successfully buffered by the buffer member 9. As a result, there is no need to provide any guard portion on the outer surface of the watch case 1 to enclose the periphery of the exterior member 10, and the watch case 1 is unconstrained by appearance and design, and therefore, design flexibility can be increased.

Further, according to the switch device 5, the square-shaped engaging flange portion 20 is provided at the outer peripheral portion of the operating head portion 18 of the operating member 7, and the fitting portion 32 to be fitted with the engaging flange portion 20 movably in the shaft direction is provided on the inner peripheral surface of the exterior member 10. Therefore, by fitting the engaging flange portion 20 of the operating head portion 18 to the fitting portion 32 of the exterior member 10, rotation of the exterior member 10 can be surely and successfully transmitted to the operating member 7 although the buffer member 9 is interposed between the operating head portion 18 of the operating member 7 and the exterior member 10. Moreover, the operating member 7 can be surely rotated together with the exterior member 10 by this.

In this case, the engaging flange portion 20 of the operating head portion 18 is formed in the square shape including the corner portions 20*a* at four corners thereof. The fitting portion 32 is formed in the circular hole slightly larger than the outer diameter of the operating head portion 18, and the engagement recess 32*a* to be individually engaged with each of the corner portions 20*a* of the square-shaped engaging flange portion 20 is formed at the edge portion of the circular hole.

Therefore, when the engaging flange portion 20 of the operating head portion 18 is fitted to the fitting portion 32 of the exterior member 10, each corner portion 20*a* of the engaging flange portion 20 can be fitted into the engagement recess 32*a* of the fitting portion 32, thereby achieving to surely and successfully transmit rotation of the exterior member 10 to the operating member 7.

Further, according to the switch device 5, the mounting member 11 is fixed at the inner periphery of the exterior member 10 such that the exterior member 10 is displaced in the shaft direction with respect to the operating head portion 18. The engaging flange portion 20 of the operating head portion 18 contacts the mounting member 11 in the direction of the watch case 1 side, thereby achieving to surely and successfully mount the exterior member 10 in a state such that the exterior member 10 is displaced in the shaft direction with respect to the operating head portion 18.

Therefore, the exterior member 10 can be surely and successfully displaced in the shaft direction with respect to the operating head portion 18 when the exterior member 10 receives impact from the outside and the buffer member 9 is elastically deformed to buffer the impact. Also, when the elastically deformed buffer member 9 is elastically returned to an original state, the exterior member 10 can also be surely and successfully displaced in the shaft direction with respect to the operating head portion 18. With this configuration, the engaging flange portion 20 of the operating head portion 18 can be made to surely contact the mounting member 11 in the directed of the watch case 1 side. Therefore, the operating head portion 18 is prevented from being slipped out from the inside of the exterior member 10.

In this case, the caulking portion 30*a* configured to fix the mounting member 11 through the caulking processing is provided at the end portion of the cylindrical portion 30 located on the watch case 1 side of the exterior member 10. The mounting member 11 can be fixed at the inner periphery of the exterior member 10 by applying the caulking processing to the caulking portion 30*a*. Therefore, the fixing strength is higher compared to a case in which the engaging flange portion 20 of the operating head portion 18 is made to directly contact the caulking portion 30*a*, and further slidability of the exterior member 10 with respect to the operating member 7 can be ensured.

Additionally, according to the switch device 5, the locking unit 8 to lock the operating member 7 in a state that the operating member 7 is pushed toward the watch case 1 is provided, and therefore, when the switch device 5 is not used, the operating member 7 can be surely locked to the watch case 1 by the locking unit 8. As a result, the switch device 5 is prevented from being actuated carelessly, and also the operating member 7 can be prevented from being moved in the shaft direction by impact even when the exterior member 10 receives the impact from the outside.

More specifically, the locking unit 8 includes: the male screw 13 provided at the cylindrical member 12 fitted into the through-hole 1*a* of the watch case 1; and the female screw 19 provided at the inner periphery of the operating head portion 18 of the operating member 7. The operating member 7 can be surely locked to the watch case 1 by screw-engaging the female screw 19 of the operating head portion 18 with the male screw 13 of the cylindrical member 12.

With this configuration, the switch device 5 is not actuated carelessly and the operating member 7 can be surely prevented from being moved in the shaft direction even though receiving impact from the outside. Thus, the impact is buffered by the buffer member 9 and cannot be directly transmitted to the locking unit 8 even when the operating member 7 is locked to the watch case 1 or even when the exterior member 10 receives the impact from the outside. Therefore, the locking unit 8 can be prevented from being damaged.

Moreover, according to the switch device 5, the projected portion 22 configured to be inserted into the insertion hole 29 of the buffer member 9 and come close to the inner surface of the exterior member 10 is provided at the operating member 7, the first space S1 is provided between the projected portion 22 and the inner surface of the exterior member 10, the second space S2 is provided between the exterior member 10 and the outer surface of the watch case 1, and the first space Si is formed wider than the second space S2. Therefore, even when the exterior member 10 receives impact from the outside, the impact can be prevented from directly being transmitted to the operating member 7.

More specifically, the first space S1 provided between the projected portion 22 of the operating member 7 and the inner surface of the exterior member 10 is set wider than the second space S2 provided between the end portion of the cylindrical portion 30 of the exterior member 10 and the outer surface of the watch case 1. Therefore, when the exterior member 10 receives strong impact and the buffer member 9 cannot sufficiently absorb the impact, the end portion of the cylindrical portion 30 of the exterior member 10 contacts the outer surface of the watch case 1 and the exterior member 10 can be prevented from contacting the projected portion 22 of the operating member 7. In this manner, the operating member 7 and the locking unit 8 can be prevented from being damaged because the strong impact is not directly transmitted to the operating member 7.

Note that, according to the above-described embodiment, the description has been given for the case in which the cylindrical member 12 is fitted into the through-hole 1*a* of the watch case 1 and the male screw 13 is formed at the outer periphery of the large-diameter cylindrical portion 12*b* at where the cylindrical member 12 is projected from the watch case 1, however; not limited thereto, a cylindrical portion may be, for example, integrally and coaxially formed with the through-hole 1*a* on the outer surface of the watch case 1 in a corresponding manner, and a male screw may be formed on the outer peripheral surface of the cylindrical portion.

In this case, the female screw 19 of the operating head portion 18 is screw-engaged with the male screw 13 of the cylindrical portion and the operating member 7 can be locked to the watch case 1 by inserting the operating shaft 17 of the operating member 7 into the through-hole 1*a* via the cylindrical portion of the watch case 1 and pushing the operating head portion 18 into the watch case 1 and rotating the operating head portion 18 in the same manner as the above-described embodiment.

With this configuration, the number of components can be reduced because the cylindrical member 12 as the separate component becomes unnecessary.

Further, according to above-described embodiment, the description has been given for the case in which the square-shaped engaging flange portion 20 is provided at the operating head portion 18 of the operating member 7, the fitting portion 32 to be fitted with the engaging flange portion 20 is provided on the inner peripheral surface of the exterior member 10, and the engagement recess 32*a* to be engaged with each of the corner portions 20*a* of the engaging flange portion 20 is provided at the fitting portion 32, however; not limited thereto, the engaging flange portion may be, for example, formed in a polygonal shape such as a triangle, a pentagon, or a hexagon, and the fitting portion may be formed in a polygonal shape to be fitted with the polygonal-shape engaging flange portion, or the engaging flange portion may be formed in an oval shape and the fitting portion may be formed in an oval shape to be fitted with an oval-shape engaging flange portion. Even in such configurations, rotation of the exterior member 10 can be surely and successfully transmitted to the operating member 7 same as the above-described embodiment.

Furthermore, according to the above-described embodiment, the description has been given for the case in which the locking unit 8 configured to lock the operating member 7 in a state that the operating member 7 is being pushed toward the watch case 1 includes the male screw 13 provided at the cylindrical member 12 and the female screw 19 provided at the operating head portion 18 of the operating member 7 and configured to be screw-engaged with the male screw 13, however; not limited thereto, same as the cited literature, a simple locking unit may be configured to include, for example: a ring member mounted on the operating head portion 18 and having a plurality of engagement projections; and a plurality of locking groove portions configured to lock, in a disengageable manner, the engagement projections of the ring member projected to the outside of the watch case 1.

Besides, according to the above-described embodiment and modified examples, the description has been given for the case in which the present invention is applied to the watch, however; not necessarily applied to the watch, the present invention can also be applied to, for example, various kinds of timepieces such as a fob watch, a travel watch, an alarm watch, and a table clock, and further, not necessarily applied to the timepieces, and the present technology may be applied to, for example, various kinds of electronic devices such as a cell phone and a portable information terminal While a certain embodiment of the present invention has been described above, but the present invention is not limited thereto, and may include the invention recited in the scope of claims and the scope equivalent thereto.

The invention claimed is:

1. A switch device comprising:

a case having a through-hole;

a movable operating member having a shaft to be inserted into the through-hole of the case;

an exterior member mounted on the operating member and configured to be displaced in an axial direction along an axis of the shaft and rotated together with the operating member; and a buffer member located at a position between the movable operating member and the exterior member without being exposed outside of the exterior member, configured to buffer transmission of impact applied from outside and inside of the device, wherein the buffer member includes a plurality of escape spaces for deformation of a shape of the buffer member, an end portion of the operating member is provided with a projected portion, the projected portion is inserted to project axially into one of the escape spaces included in the buffer member, and a first axial space between the projected portion and an inner surface of the exterior member is axially larger than a second axial space between the exterior member and the case.

2. The switch device according to claim 1, wherein a non-circular engaging flange portion is provided at an outer periphery of the operating member, and a fitting portion to be fitted with the engaging flange portion in a manner movable in a shaft direction is provided at an inner periphery of the exterior member.

3. The switch device according to claim 2, wherein a mounting member to mount the exterior member is mounted so as to displace the exterior member in a shaft direction with respect to the operating member, fixed at the inner periphery of the exterior member, and contacts the engaging flange portion of the operating member.

4. The switch device according to claim 1, wherein a locking unit configured to lock the operating member is provided.

5. The switch device according to claim 2, wherein a locking unit configured to lock the operating member is provided.

6. The switch device according to claim 3, wherein a locking unit configured to lock the operating member is provided.

7. A timepiece comprising a switch device according to claim 1.

* * * * *